US005180072A

United States Patent [19]

Oehlert

[11] Patent Number: 5,180,072

[45] Date of Patent: Jan. 19, 1993

[54] SAFETY CONTAINER AND CLOSURE SYSTEM WITH CHILD RESISTANCE

[76] Inventor: Neil L. Oehlert, 2326 N. 81st. St., Omaha, Nebr. 68134

[21] Appl. No.: 557,169

[22] Filed: Jul. 23, 1990

[51] Int. Cl.[5] ..... B65D 55/02

[52] U.S. Cl. ..... 215/209; 215/206; 215/211; 215/237; 220/281; 206/1.5

[58] Field of Search ..... 215/206, 209, 211, 224, 215/355, 201, 228, 235, 237, 238; 220/307, 339, 281; 206/1.5

[56] References Cited

U.S. PATENT DOCUMENTS

| | | | |
|---|---|---|---|
| 1,182,678 | 5/1916 | Haslett | 215/206 |
| 3,443,712 | 5/1969 | Hauser | 215/209 |
| 3,529,648 | 9/1970 | Bartilson | 220/307 X |
| 3,587,896 | 6/1971 | Graff | 215/206 |
| 3,643,830 | 2/1972 | Kinney | 220/307 |
| 3,672,536 | 6/1972 | Kinney et al. | 220/307 |
| 3,817,420 | 6/1974 | Heisler | 220/307 |
| 3,830,393 | 8/1974 | Schaefer | 215/209 |
| 4,042,105 | 8/1977 | Taylor | 215/209 X |
| 4,043,448 | 8/1977 | Tanaka | 215/209 X |
| 4,065,017 | 12/1977 | Burton | 215/211 |
| 4,118,616 | 10/1978 | Whittkamp et al. | 206/387 |
| 4,121,727 | 10/1978 | Robbins et al. | 215/211 |
| 4,146,170 | 3/1979 | Medendorp | 220/307 X |
| 4,520,943 | 6/1985 | Nielsen | 220/281 |
| 4,667,821 | 5/1987 | Shillington | 220/307 X |
| 4,770,318 | 9/1988 | Earl | 220/307 |
| 4,850,504 | 7/1989 | Grindrod et al. | 220/307 |

FOREIGN PATENT DOCUMENTS

| | | | |
|---|---|---|---|
| 530217 | 7/1955 | Italy | 220/307 |
| 1442216 | 7/1976 | United Kingdom | 215/209 |
| 4498447 | 1/1978 | United Kingdom | 215/209 |

OTHER PUBLICATIONS

Marilyn Bakker, The Wiley Encyclopedia of Packaging Technology, pp. 536–540.

*Primary Examiner*—Stephen Marcus
*Assistant Examiner*—Stephen Cronin
*Attorney, Agent, or Firm*—Chase & Yakimo

[57] ABSTRACT

A container having a child resistant closure which is secured by an internal latch and is openable by application of opposing pinching forces to the sides of the container to cause the sides to flex inwardly and thereby release the latch. The closure is provided with child resistance by the provision of stiffening ribs on the closure which direct flexing in one direction to provide release of the container latch and by the provision of tabs which serve to distract the child's attention and encourage application of pressure at a position on the container which will not release the closure.

20 Claims, 2 Drawing Sheets

Fig. 2
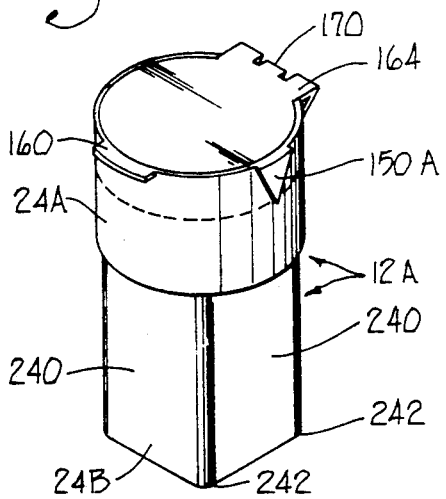
Fig. 3
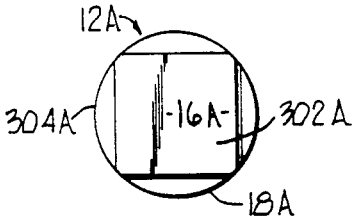
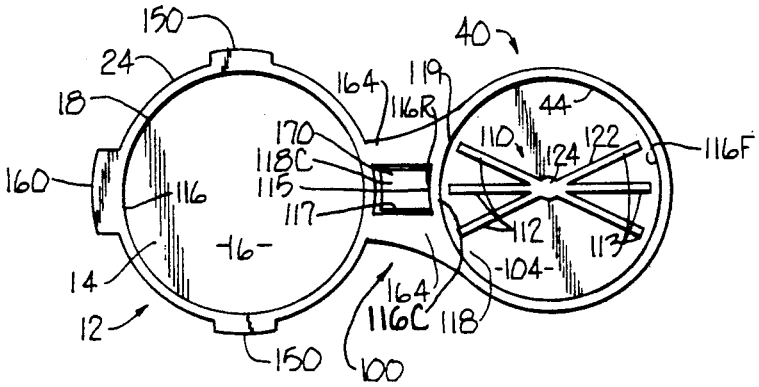
Fig. 4
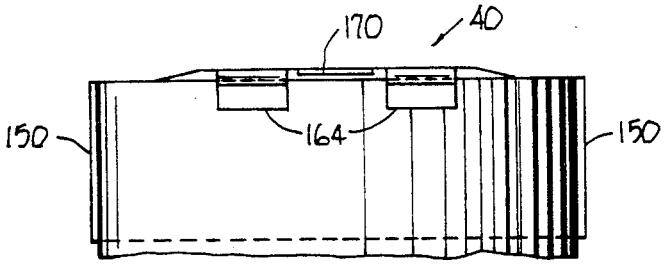
Fig. 5
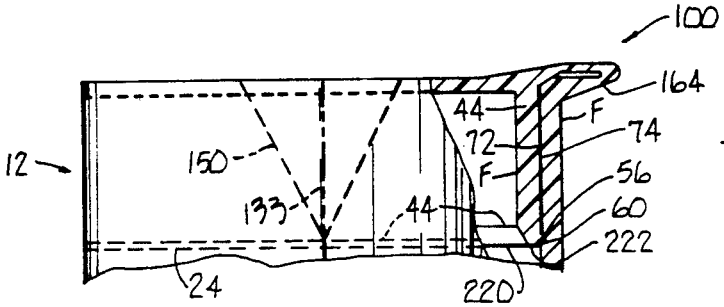
Fig. 6

SAFETY CONTAINER AND CLOSURE SYSTEM WITH CHILD RESISTANCE

FIELD OF THE INVENTION

This invention is in the field of safety closures for containers or vials, as these are often filled with dangerous medicine, they are purposely made difficult for children to open.

BACKGROUND

In this field the earlier safety container and closure units have been sufficiently difficult for children to open that they have met the U.S. Government poison prevention packaging standards.

Such earlier units have also met the U.S. Government poison prevention packaging standards minimum requirements for ease of ability of opening by adults.

However, other safety enclosure units, now in use, have all been very aggravating for adults to open in this busy life.

This is due to (1) the excessive complexity of motions required for opening; or (2) the amount of arm, shoulder, hand, and finger strength needed for opening. This is a special problem for the elderly, and for arthritic persons, and amputees. When totalled, these groups account for a very substantial number of medicine takers.

The new concept hereof is to provide a unit, the container of which can be squeezed forcing the closure out as accomplished by cooperating inclined services on the container and closure. If a vial could be squeezed from any side and still open, then there would be excessive danger that a child could accidentally squeeze it open as they experiment with it. A hinge attaching the closure to the container has been discovered to prevent a child from successfully squeezing the lid out when pressing on the hinge side of the container.

It is not necessary that 100% of the children tested find it unable to open a medicine vial. No system has been found that is childproof. For example: If 200 children, between the ages of 36 and 54 months, attempt to open a container and closure unit and if at least 80% cannot successfully open the unit, the unit will be approved.

The government standard for testing is to set a five minute limit for a first test in which a child is allowed to try to open a safety unit without any instruction or demonstration. The second phase of the same test is to set a five minute limit for a child to attempt to open a unit after the child has been shown a demonstration in which they see it opened by an adult, but without any explanation about how the opening is done. In this latter test, the squeeze type unit hereof can be demonstrated before the child's close inspection and yet the child will almost always fail to learn from the demonstration if the adult maintains one finger in a position above the enclosure to limit its degree of opening.

A new feature hereof is to provide a lid that is substantially at the same level on its outer side with the upper edges of the container to prevent opening by any gripping of the closure lid. Still another object is to provide a false lip projecting outwardly from the unit to distract the child into spending time trying to open the unit by pushing or pulling on the lip. Such a false lip is in a position such that force on it would have no effect on opening.

Arrows projecting from the side of the container indicate where to press and protrude sufficiently felt by persons with poor eyesight or in a darkened bedroom. The lid is printed with "squeeze arrows" or other indicia but neither the print or the meaning of the arrows are understandable to small children.

The lid can be printed with the words "cover lid lightly", printed above the "squeeze arrows" instruction, so that an adult can know to first place a finger in position to cover the lid lightly before squeezing . This is not necessary for opening, but prevents forceful expelling and spilling of contents.

Stiffening ribs extend from the hinge side of the lid to its opposite side and extend downwardly from, and are integral with, the underside of the lid. The ribs decrease flexibility and make it difficult for a child to press the container and lid sufficiently to propel the lid outward.

It is preferred that the ribs be not attached to the downwardly extending edge portions of the lid so they do not prevent right and left sides of the lid from easily moving inwardly for the desired opening deformation. If the ribs are attached to the forward and rearward sides of the downwardly extending circumferential lid flange, they will prevent the forward and rearward sides of the flange from moving away from each other as is desirable for opening.

It is also an objective to provide for a distraction tab extending outwardly from the container. It has been discovered that if the tab is disposed between two sections of the hinge it provides a crevice into which a child can insert a fingernail or even teeth in an attempt to pry the tab upward to try to open the lid. The child, however, cannot affect opening no matter how hard the child tries in pulling and pushing the tab.

Container designers and merchandisers sometimes prefer containers that are square in horizontal cross-section. Commonly such units have had the common screw-cap but with a rectangular lower part of the container much larger in horizontal cross-section. Such a construction cannot be injection molded because there is no way to withdraw the central part of the mold. Therefore, it is also an affect to provide an injection moldable container which has substantial parts of its surface rectangular in shape and which is also a safety container unit. This is accomplished with the use of the square part of the bottle smaller than the upper circular closure portion of the bottle.

Yet another objective is to provide for lesser thickness at the top of the container side wall, as accomplished by a taper so that the side wall flexes for ease of opening by arthritic and handicapped persons.

Another objective is to provide complimentary tapering also on the outer side of the downwardly extending lid flange for enhancing outward propulsion.

An objective is to provide an internal closure in a safety unit having a hinge connection.

Still another objective is to provide a one piece container and enclosure unit capable of meeting the U.S. Government poison prevention packaging standards.

A further objective is to provide a unit which is openable by squeezing.

Yet a further objective is to provide a safety unit in which a single motion is needed to gain access, and to eliminates cumbersome safety latches to make it possible for a person crippled with arthritis, or paralyzed, to open the container by biting.

A further objective is to eliminate the sharp locking latches of former safety units, as they wear away at weak, sharp corners and cease to lock.

Yet another objective is to provide a connection between the container and closure, which does not require twisting, turning, or rotation of a closure to achieve opening.

Another objective is to provide a safety container in which the lid fits inside the top of the container where a child cannot grip it.

An objective is to provide features designed to distract, puzzle, and baffle children.

Another objective is to provide a desirable safety unit openable without external mechanism.

A further objective is to provide a safety unit requiring only one continuous motion for release and expulsion of the lid, and more specifically, by a single squeeze motion.

Another objective is to provide a medicine container system which can be pressed against a desk top or doorway edge for emergency opening by a weak person, or which can be opened by a pinching between two hands, if there is not strength enough in one hand.

Another objective is to provide a safety vial that can yet be opened by a person with no hands by pressing on the vial hereof with the sides of ones wrists, and other comprehensive methods.

An objective hereof is to provide a safety unit having an interlocking means without sharp corners which can be worn away to ineffectiveness as a result of repeated operation of the easily worn away soft plastic parts.

Another objective is to provide a safety unit easily

Some safety containers-and-closure units heretofore having required multiple operations for their opening such as applying pressure to a closure to release a locking mechanism and simultaneously rotating the closure to unthread the closure. Others require the rotation of the closure with respect to the container body to align release points, after which The closure is removed. In some containers an unthreading step is also needed for closure removal.

Still another type of safety container requires pressure to be applied to release the engaging locking mechanisms whereby the closure and container body slide with respect to each other so that the closure may be removed.

Such earlier safety container units, all requiring multiple opening steps, have a disadvantage in that the closure and container must be molded separately, thus requiring more costly tooling and more separate-handling of containers and lids. Thus it is also an object of the present invention to avoid these problems of the prior art.

It is an objective of this invention to provide a safety container and lid unit that can be more economically and easily made of one piece of material. It is a further objective of the invention to provide a one-piece safety and lid unit container made of a single plastic material with an integrally formed hinge connecting the integrally formed closure and container body, providing economy by eliminating assembly steps and separate parts inventory and separate parts handling.

Other objects and advantages of this invention will become apparent from the following description taken in connection with the accompanying drawings, wherein is set forth by way of illustration and example, an embodiment of this invention.

IN THE DRAWINGS

FIG. 2 is a perspective view of an alternate embodiment of the present invention having a lower portion with flat outer sides, the lid being in a closed position.

FIG. 3 is a top view of the vial of FIG. 2 with the lid open.

FIG. 4 is a top plan view of the embodiment of FIG. 1 shown with its cap opened.

FIG. 5 is a rear elevation of the embodiment FIG. 1 showing the upper portion with the position of the cap shown in phantom lines.

FIG. 6 is a side elevation of the embodiment of FIG. 1 with the vial, cap, and a hinge in partial cross-sectional view.

DESCRIPTION OF THE PREFERRED EMBODIMENT

Figure 1:
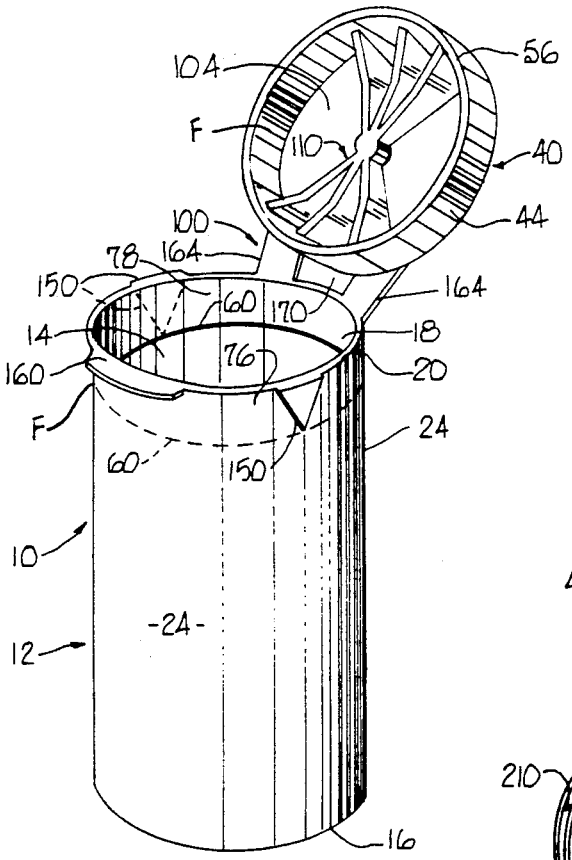
FIG. 1 is a perspective view of the safety container and closure system hereof, with the lid open.

In FIG. 1 a safety container and closure unit or system 10 including a vial or container 12. The vial can be of any size convenient for receiving medicines dangerous for children to swallow.

Container 12 has an interior cavity 14 and has a closed bottom 16 and has an opening 18 at top 20. Container 12 has a side wall 24 substantially surrounding the interior cavity 14.

A lid, cap, or cover 40 covers the opening 18 and has a downwardly protruding flange 44.

Side wall 24 and flange 44 define a pair of flexors F. In the system 10 of FIG. 1, the side wall 24 defines an outer flexor disposed outwardly of an inner flexor which latter is the flange 44.

A circular latch 56 protrudes from the lower outer side of the flange 44 and is at least partly receivable in a catch or circular recess 60 on the inner side of the side wall 24 for cooperatively interlocking for normally holding the closure 40 onto the container 12. The container 12 and the closure 40 define a pair of main parts of the system 10.

In FIG. 6, the flexors F each have thereon an inclined surface, 72 or 74. In FIG. 5, a frustro-conical first inclined surface 74 facing outward is on the flange 44 with its lesser diametered portion at its inner or bottom end, a frustro-conical second inclined surface 72, facing inward, with its lesser diametered portion at its top or outer end on the inner side of the side wall 24. The inclined surfaces 72 and 74 are so cooperatively shaped that when sufficient pressure is applied to two opposite sides, such as the right and left sides, of the outer flexor, which is the side wall 24, latch 56 will be forced out of the catch 60 accomplishing opening of container 12.

The required pressure for a medicine vial safety unit 10 can be an amount of pressure that an average adult person with average strength, or any normal adult person, is capable of applying by the pinching of the outer flexor, which is the vial 12 on opposite sides. In the embodiment of FIG. 1, the right side 76 and left side 78 are compressed between the thumb and a finger of the same hand.

System 10 presents a hinge module 100 on the rear side 104 of the container 12 which interconnects container 12 with closure 40 rear side 104 is defined.

Hinge 100 serves to limit the flexing of the flexors F when pinching pressure is applied by a child on the hinged rear side of the side wall 24, and on the opposite or front side of the side wall 24.

System 10 of FIG. 1 has its hinge module 100 formed as one piece with the container 12 and the closure 40 for a rapid injection molding. The material discovered to be practical is a polypropylene copolymer in a range of melt flow of from 15 to 25, with the most preferable range being from 18 to 22, and with an IZOD range of from 2 to 12 foot-pounds, preferably 8 to 10 foot-pounds.

Testing has shown that polypropylene copolymer at stiffer ranges outside of the stated melt flow and IZOD ranges causes the vial to be to stiff for an average adult. At such high IZOD ranges the finger pressure for unlatching becomes too difficult for some persons to apply. Materials other than polypropylene copolymer can be found in these ranges but (a) are not acceptable for holding medication or (b) do not make a long-life hinge for example when 100 pills are stored, the hinge module must hold through 100 openings.

In FIG. 1, the closure 40 has a central portion 104 substantially surrounded by the flange 44. An elongated rib assembly 110 on the underside of the central portion 104 is of one piece with the central portion 104 and causes the closure central portion 104 to be thicker and stiffer along the rib assembly 110.

In FIG. 4, the rib assembly 110 is seen to be elongated in a direction approximately extending from adjacent the closure flange 44 on the hinged rearward portion of the flange 44 and toward the front side of the closure 40. The rib assembly 110 has rearward ribs 112 and forward ribs 113, each spaced from the flange 44 to avoid a holding-in of the flange 44 at the ends of the rib assembly 110. This is needed for free bending-out of the flange 44 at the hinged backside 115 and at the front side 116 for ease of adult opening.

The ribs 112 and 113 are close enough to the flange 44 to substantially block latch-and-catch-unlocking inward movement of the flange 44 at the back and front sides 115 and 116 of the system 10 so as to deter a child from opening it.

In FIG. 4, the rib assembly 110 has the capability of substantially blocking the flange 44 from being bent inwardly specifically at a forward side blocking area 116F and at a hinged or rearward side blocking area 116R respectively disposed at forward and rearward back ends of the rib assembly 110. The rearward, or hinged side blocking area 116R has a central blocking portion having a center 116C on, or substantially adjacent, a forward-to-rearward extending line 117 through the center 118C of the hinge module 100. The rearward side blocking area 116R has outermost portions 118 and 119 adjacent to the outermost right and left sides respectively, of the hinge module 100.

The central part 122 of the central portion 104 of the closure 40 has a hub or rib anchoring point 124. The rib assembly 110 has a plurality of rearward ribs 112. A plurality of forward ribs 113 of the assembly 110 are anchored to the rearward ribs 112 at the anchoring point 124.

The forward ribs 113 are inclined with respect to each other and extend outwardly from the anchoring point 124 to have horizontally spaced outer ends in similarity to the spokes of a wheel having a vertical axis. The rearward ribs 112 are similarly attached together and to the forward ribs 113 at the anchoring point 124 and inclined outwardly like the spokes of a wheel.

The flexors F are sufficiently flexible and so-shaped that a force can be applied by substantially any normal adults, against the system 10 sufficiently for assisting the adult to gain access to the cavity 14. The force applied is a pinching of the side wall 24 on its left and right sides about one quarter inch from the top of the container 12 and at the level of the flange 44.

The entire closure 40 is disposed substantially within the outlines of the container 12 to increase difficulty of gripping the closure 40 and for child safety.

Opening is accomplished by pinching the flexors between the thumb and a finger of the same hand causing the latch 56 to be forced out of the catch 60 for an unlocking.

The inward-bending of the outer flexor F is at a point below the upper end of the container and sufficient force of pinching on the right and left sides of the container at such a position can cause a closure to be expelled. However the amount of force that a small child can apply in such positions is not sufficient to cause opening.

In FIG. 1 and 4, it is shown that the outer flexor F, which is container 12, has on its right and left sides, distractors 150 jutting out from the sides thereof. The distractors are shaped and positioned such that when a vertical force or a forwardly or rearwardly directed force is exerted on said right or left distractors, this will not affect opening of the unit 10. Each distractor 150 has a blunt, horizontally facing, outer side against which horizontal right and left pushing forces can be exerted to open the safety unit 10. Right and left distractors 150 also serve as pressure point indicators for assisting opening in the dark.

Distractors 150 extend from the upper edge of the container down across the area of the container which spans the depth of the flange 44.

Container 12 has a horizontally protruding distraction lip 160 which, when forced against by a child cannot affect opening. Distraction lip 160 is attached to the forward side of the container 12.

In FIGS. 4 and 5, hinge 100 has right and left hinges 164, spaced apart. One of the flexors F has a horizontally protruding distraction lip 170 which when forced by a child cannot affect opening of said system. The distraction lip 170 is attached to the lid or closure 40 and is disposed between the right and left hinges 164.

Figure 7:
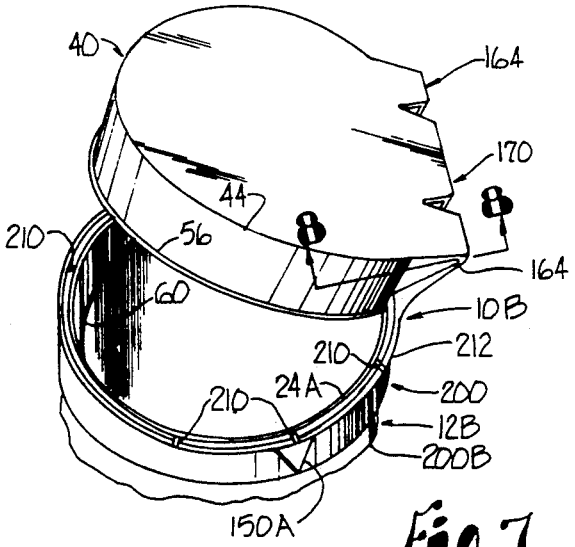
FIG. 7 is a perspective view of the top portion only of a third embodiment of the invention wherein a ring attaches a separate closure unit to a vial.
Figure 8:
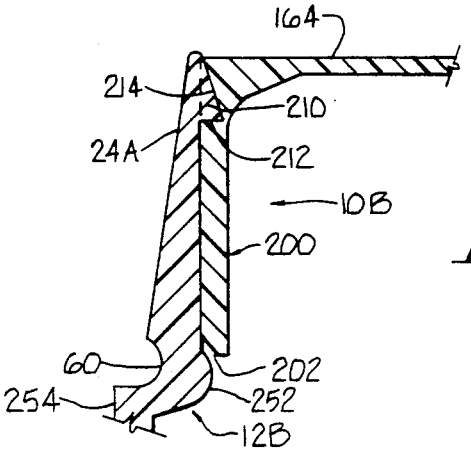
FIG. 8 is a sectional view taken along line 8—8 of FIG. 7.

In FIGS. 7, and 8, the system 10B has an annular ring or anchor 200 surrounding an upper portion of the container 12B and is made of a separate piece of material from the container 12B. The anchor 200 and the container 12B are so shaped as to be interlocked so that the anchor or ring 200 is deterred from coming off the container 12B. This is done by having hooks 210 on the upper part of the container side wall 24A. There can be many hooks 210 and they each extend out over part of the top of the ring anchor 200.

In FIG. 6 a circular seal 222 can extend across the opening 18 of the container 12 and its edge can rest in the lower part of the circular recess 60 where the edge of the seal 222 can adhere to container 12.

In FIG. 2, the embodiment shown has a container 12A having four flat side wall areas 240 on a lower substantially rectangular section 240 disposed beneath a cylindrical section 24A. Rounded corners 242 are disposed between the flat side wall areas 240.

FIG. 3, shows a bottom wall 16A substantially rectangular and above it a substantially boxlike recess 302A, above which is a cylindrical recess 18A whereby horizontal ledges 304A are seen therebetween on the four sides.

In FIG. 7, the lower part 200B, the container 12B is larger than the cylindrical upper part and so the container 12B must be made separately from the cap 40, which is why the anchor 200 is used to anchor the cap 40 to the container 12B. The anchor 200 is beveled on the underside innermost edges to slip on easier.

In testing, it has been found that children push and pull up on the lip 160 of FIG. 1, the protruding distractors 150, or 150A, and the back distraction lip 170 all without opening.

If the child squeezes, it is usually with a full hand force on all sides, not a pinch, and opening does not occur.

Distractors 150 and 150A also serve as indicators to an adult of where to push and so are made in downwardly pointed triangular arrowhead shape.

It is to be understood that while a certain form of this invention has been illustrated and described, it is not limited thereto, except insofar as such limitations are included in the following claims and allowable functional equivalents thereof.

Having thus described the invention what is claimed as new and desired to be secured by letters patent is as follows:

1. A child resistant safety device comprising: a container body having a flexible sidewall presenting an opening thereby defining an interior cavity adapted to receive a substance therein, a flexible closure for covering said opening, hinge means mounting said closure on said body and providing an axis for swinging movement of said closure between open and closed positions relative to said opening, a flange extending from said closure for reception within said interior cavity of said container body adjacent to said sidewall, latch means for securing said closure within said opening, and said flange having flexible means responsive to opposing forces applied to said sidewall along a line of action generally parallel to said axis of swinging movement of the closure for releasing said latch means and urging said closure from said opening toward said open position thereof, thereby to permit access to said interior cavity of said container body.

2. The device as claimed in claim 1 wherein said closure is provided with means for substantially preventing flexing of said closure transversely of said line of action of said opposing forces while permitting flexing of said closure and said container body along said line of action.

3. The device as claimed in claim 2 wherein said means for preventing flex comprises at least one rib on said closure extending transversely of said line of action to prevent flexing of said closure longitudinally of said rib.

4. The device as claimed in claim 1 further comprising a distractor element projecting from said container body, said element being adapted to mimic a catch mechanism thereby presenting a false catch mechanism to a child.

5. The device as claimed in claim 1 wherein said container body is elongated and has a open end which is normally covered by said closure, said hinge means mounting said closure on said end with said axis of swinging movement extending transversely of said body.

6. The device as claimed in claim 1 wherein said hinge means is integrally formed with said container body and said closure.

7. The device as claimed in claim 1 wherein said container body, said hinge means, and said closure are composed of polypropylene.

8. The device as claimed in claim 1 wherein said container body is provided with a bottom spaced from said opening.

9. The device as claimed in claim 1 wherein said sidewall, closure and flexible means are composed of a material having a melt flow range of from 15 to 25 and an IZOD Range of from 2 to 12 foot pounds.

10. The device as claimed in claim 1 wherein said sidewall, closure and flexible means are composed of a material having a melt flow range of from 18 to 22 and an IZOD Range of from 8 to 10 foot pounds.

11. A child resistant safety device comprising:

a container body having a flexible sidewall presenting an opening thereby defining an interior cavity adapted to receive a substance therein, a flexible closure for covering said opening, hinge means mounting said closure on said body and providing an axis for swinging movement of said closure between open and closed positions relative to said opening, a flange extending from said closure for reception within said interior cavity of said container body adjacent to said sidewall, latch means for securing said closure within said opening, and flexor means for inward flexing of opposing portions of said sidewall and said flange in response to opposing forces applied to said sidewall along a line of action generally parallel to said axis of swinging movement of the closure, whereby said latch means is released and said closure is forced out of said opening in said container body.

12. A child resistant safety device comprising:

a tubular container body having a flexible sidewall presenting an opening thereby defining an interior cavity adapted to receive a substance therein, a flexible closure integral with said container body and having means providing an axis for swinging movement of said closure between open and closed positions relative to said opening, said closure further having means for flex directing to substantially prevent flexing of said closure along an axis of said flex directing means while permitting flexing of said closure and said container body transversely of said axis of said flex directing means, a flange extending from said closure for reception within said interior cavity of said container body adjacent to said sidewall and having an annular bead thereon, an annular detent on said sidewall registrable with said bead, said annular bead and annular detent, when in registration, securing said closure within said opening, and said flange having flexible means responsive to opposing forces applied to said sidewall along a line of action generally parallel to said axis of swinging movement of the closure for releasing said annular bead from registration with said annular detent and urging said closure from said opening, thereby to permit access to said interior cavity of said container body.

13. The device as claimed in claim 12 further comprising a distractor element projecting from said container body, said element being adapted to mimic a catch mechanism thereby presenting a false catch mechanism to a child.

14. The device as claimed in claim 12 wherein said container body, said closure, and said flange are composed of polypropylene.

15. The device as claimed in claim 12 wherein said means for flex directing comprises at least one rib on said closure extending along a second axis generally orthogonal to said axis of swinging movement to prevent said flexing of said closure.

16. A child resistant safety device comprising:

a container body having a flexible sidewall presenting an opening thereby defining an interior cavity adapted to receive a substance therein, a flexible closure for covering said opening, a flange extending from said closure for reception within said interior cavity of said container body adjacent to said sidewall, latch means for securing said closure within said opening, a distractor element projecting from said container body, said element being adapted to mimic a catch mechanism thereby presenting a false catching mechanism to a child, and said flange having flexible means responsive to opposing forces applied to said sidewall for releasing said latch means and urging said closure from said opening, thereby to permit access to said interior cavity of said container body.

17. A child resistant safety device comprising:

a container body having a flexible sidewall presenting an opening thereby defining an interior cavity adapted to receive a substance therein, a flexible closure integrally formed with said container body, said closure having means for flex directing to substantially prevent flexing of said closure along an axis of said flex directing means while permitting flexing of said closure in said container body transversely of said axis of said flex directing means, a flange extending from said closure for reception within said interior cavity of said container body adjacent to said side wall and having an annular bead thereon, an annular detent on said sidewall registrable with said bead, said annular bead and annular detent, when in registration, securing said closure within said opening, a distractor element projecting from said container body, said element being adapted to mimic a catch mechanism thereby presenting a false catch mechanism to a child, and said flange having flexible means responsive to opposing forces applied to said sidewall for releasing said annular bead from registration with said annular detent and urging said closure from said opening, thereby to permit access to said interior cavity of said container body.

18. A child resistant safety device comprising:

a container body having a flexible sidewall presenting an opening thereby defining an interior cavity adapted to receive a substance therein, a flexible closure for covering said opening, hinge means mounting said closure on said body and providing an axis for swinging movement of said closure between open and closed positions relative to said opening, a continuous, peripheral flange extending from said closure for complemental reception within said interior cavity of said container body in contact with said sidewall, latch means for securing said closure within said opening, and said flange having flexible means responsive to opposing forces applied to said sidewall along a line of action generally parallel to said axis of swinging movement of the closure for releasing said latch means and urging said closure from said opening toward said open position thereof, thereby to permit access to said interior cavity of said container body.

19. The device as claimed in claim 18 wherein said container body is tubular and has an end defining said opening.

20. The device as claimed in claim 19 wherein said flange is of annular configuration.

* * * * *

UNITED STATES PATENT AND TRADEMARK OFFICE

CERTIFICATE OF CORRECTION

PATENT NO. : 5,180,072

DATED : January 19, 1993

INVENTOR(S) : Neil L. Oehlert

It is certified that error appears in the above—identified patent and that said Letters Patent is hereby corrected as shown below:

Column 3, line 32, after the word "easily" insert --opened by blind persons.--.

Column 4, line 7, after the word "position" insert --.--.

Column 4, line 35, delete the paragraph indention.

Column 4, line 65, delete "opposite" and insert --opposing--.

Column 5, line 18, after "be" delete "to" and insert --too--.

Column 7, line 32, after ":" insert a paragraph indention.

Column 7, line 35, delete the paragraph indention.

Column 7, line 36, after "therein," insert a paragraph indention.

Column 7, line 37, after "opening," insert a paragraph indention.

Column 7, line 40, delete the paragraph indention.

Column 7, line 40, after "opening," insert a paragraph indention.

Column 7, line 43, delete the paragraph indention.

Column 7, line 43, after "sidewall," insert a paragraph indention.

UNITED STATES PATENT AND TRADEMARK OFFICE

CERTIFICATE OF CORRECTION

PATENT NO. : 5,180,072

DATED : January 19, 1993

INVENTOR(S) : Neil L. Oehlert

It is certified that error appears in the above—identified patent and that said Letters Patent is hereby corrected as shown below:

Column 7, line 45, delete the paragraph indention.

Column 7, line 47, delete the paragraph indention.

Column 9, line 34, delete the paragraph indention.

Signed and Sealed this

First Day of February, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,180,072

DATED : January 19, 1993

INVENTOR(S) : Neil L. Oehlert

It is certified that error appears in the above-indentified patent and that said Letters Patent is hereby corrected as shown below:

Column 7, line 39, delete the paragraph indention.

Column 7, line 45, insert a paragraph indention.

Signed and Sealed this

Sixth Day of September, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,180,072

DATED : January 19, 1993

INVENTOR(S) : Neil L. Oehlert

It is certified that error appears in the above-indentified patent and that said Letters Patent is hereby corrected as shown below:

Column 4, line 7, after the word "position" insert --.--.

Column 4, line 35, delete the paragraph indention.

Column 4, line 65, delete "opposite" and insert --opposing--.

Column 5, line 18, after "be" delete "to" and insert --too--.

Column 7, line 32, after ":" insert a paragraph indention.

Column 7, line 35, delete the paragraph indention.

Column 7, line 36, after "therein," insert a paragraph indention.

Column 7, line 37, after "opening," insert a paragraph indention.

Column 7, line 39, delete the paragraph indention.

Column 7, line 40, after "opening," insert a paragraph indention.

Column 7, line 43, delete the paragraph indention.

Column 7, line 43, after "sidewall," insert a paragraph indention.

UNITED STATES PATENT AND TRADEMARK OFFICE

CERTIFICATE OF CORRECTION

PATENT NO. : 5,180,072

DATED : January 19, 1993

INVENTOR(S) : Neil L. Oehlert

It is certified that error appears in the above-indentified patent and that said Letters Patent is hereby corrected as shown below:

Column 7, line 45, insert the paragraph indention.

Column 7, line 47, delete the paragraph indention.

Column 9, line 34, delete the paragraph indention.

This certificate supersedes Certificate of Correction issued February 1, 1994 and September 6, 1994.

Signed and Sealed this

Thirty-first Day of January, 1995

Bruce Lehman

*Attest:*

BRUCE LEHMAN

*Attesting Officer*

*Commissioner of Patents and Trademarks*